US005570654A

United States Patent [19]

Rood

[11] Patent Number: 5,570,654

[45] Date of Patent: Nov. 5, 1996

[54] FOLDING AUXILIARY SEAT FOR PERSONAL WATER CRAFT

[76] Inventor: Richard K. Rood, 2 Hummingbird La., Henderson, Nev. 89014

[21] Appl. No.: 536,594

[22] Filed: Oct. 10, 1995

[51] Int. Cl.[6] ..... B63B 17/00

[52] U.S. Cl. ..... 114/363; 114/270; D12/307

[58] Field of Search ..... 114/363, 270; D12/307, 300, 310, 318

[56] References Cited

U.S. PATENT DOCUMENTS

| | | | |
|---|---|---|---|
| 4,945,852 | 8/1990 | Kobayashi | 114/363 |
| 5,136,963 | 8/1992 | Zuzik | 114/363 |

*Primary Examiner*—Jesus D. Sotelo
*Attorney, Agent, or Firm*—Gregory J. Nelson

[57] ABSTRACT

An auxiliary seat attachable to the hull of a personal water craft to provide additional seat space for the passenger. In a preferred embodiment, the seat is a retractable and is foldable to an out-of-the-way position against the aft portion of the hull to allow riders to board from the rear of the water craft. The seat is pivotally secured to the rear of the hull in a deployed position supported by brace means pivotally secured at one end to the seat frame at the other end slidable in a track having a detent which is engaged by the braces when the seat is raised to the deployed use-position. The seat may also be fixed to the hull by a rearwardly extending cantilever support.

11 Claims, 2 Drawing Sheets

FOLDING AUXILIARY SEAT FOR PERSONAL WATER CRAFT

BACKGROUND OF THE INVENTION

The present invention relates to a seat and more particularly relates to a foldable seat for a personal water craft which provides additional seat space for a passenger.

Personal water craft have become very popular. These types of water craft are driven by a small engine and have an elongate bench-type seat which seats a driver and one or two passengers. The driver is located at a forward position on the seat and operates the water craft. Virtually all two, and most three-seat, personal water craft are uncomfortable and awkward for both the passengers and the operator. Passengers are afforded very little seat space and the presence of the passengers may interfere to some extent with the drivers comfort and ability to operate the water craft. When carrying passengers, it often becomes difficult for the driver to sit in a comfortable and natural position.

BRIEF SUMMARY OF THE INVENTION

Accordingly, there is a need for an accessory or auxiliary seat that is attachable to a personal water craft to provide additional seat space for the passenger which seat is retractable when not in use or to allow a rider to board the water craft from the rear of the craft. Briefly the present invention provides an auxiliary seat which is attachable to a personal water craft at the rear of the hull. The seat attaches by brackets which are secured in existing holes which are provided for grip handles or may be secured by drilling holes in the hull of the boat to secure mounting brackets at opposite side of the hull adjacent the aft portion of the hull. The brackets pivotally support a seat frame to which may be attached a seat surface covered with a suitable environmentally resistant cover and padding material. A pair of fixed rails are also secured by suitable fasteners to the inclined aft portion of the hull. The rails each define a track having a detent at the lower end. One or more braces are pivotally secured to the seat frame and have a cross member at their opposite end which is received within the track of the rail member. The seat has a retractable or folded position in which the seat assumes a position adjacent the aft portion of the boat hull. When the seat is used, the accessory seat may be pivoted upwardly and locked in place by engaging the brace in the detent portion of the track. The weight of a rider on the seat will tend to hold the seat in the proper position. When the seat is in the down, or stored, position, a spring acts to maintain the seat in this position. Grips or grab handles may also be associated with the bracket for the convenience of the passenger. In an alternate embodiment the auxiliary seat is fixed.

BRIEF DESCRIPTION OF THE DRAWINGS

The invention will be more fully understood from the following description, claims and drawings in which:

DETAILED DESCRIPTION OF THE INVENTION

Figure 1:
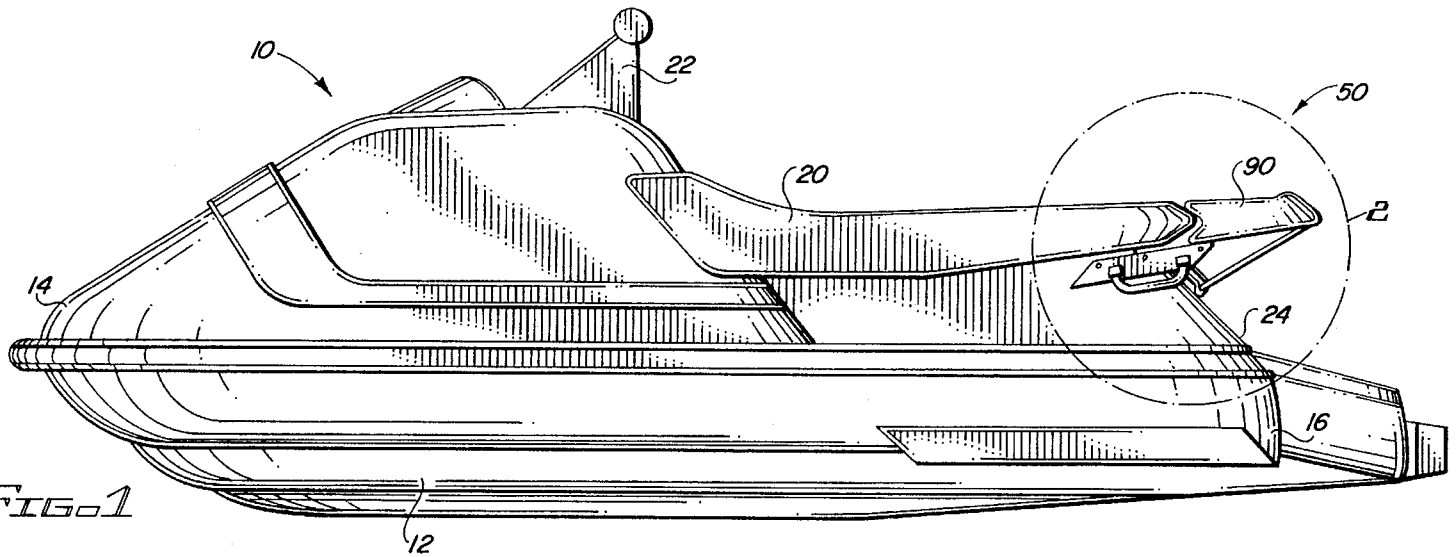
FIG. 1 is a side elevational view of a personal water craft with the accessory seat of the present invention attached thereto and shown in a deployed or riding position.

Referring to FIGS. 1 to 6, a personal water craft of conventional design is shown and is generally designated by the numeral 10. The personal water craft has a hull 12 with bow 14 and a stern 16. The hull supports a bench-type seat 20 which extends rearwardly and provides a location for the driver to sit and will accommodate one or more passengers. The driver normally sits forwardly on the seat 20 so as to be able to navigate the water craft at steering bars 22. The aft portion of the hull is normally rearwardly inclined at 24.

Most two and three seat personal water crafts provide only limited space for passengers. It is generally awkward or uncomfortable for both the driver and the passengers with conventional seats. For example, with a driver or operator and a passenger on a two seat water craft, the operator is placed in a position forward of a comfortable and safe position for operation of the water craft. The present invention eliminates this problem by providing the passenger ample space behind the driver, freeing additional seating space for the driver. The accessory or auxiliary seat of the present invention is generally designated by the numeral 50 and is attached to the aft portion 24 of the hull 12. The auxiliary seat includes a pair of brackets 52 and 54 which are each bar-like members and which are secured at opposite sides of the hull 12 and projecting rearwardly beyond the inclined rear hull surface 24. Brackets 52 and 54 are normally secured slightly below the edge of seat 20 and are secured by fasteners 56 which may be positioned in existing holes which are conventionally provided for a grip handle. To install the invention, the grip handle first would be removed and the brackets 52 and 54 secured in the position shown in the drawings. If existing holes are not provided, holes would be drilled in the hull for receipt of fasteners 56. For the convenience of the user, the brackets are shown as each having a generally U-shaped grip 58 which is pivotally secured to rod 60 on the brackets 52 and 54. In this way, the grips will assume the position adjacent to hull 12 when not in use but can be conveniently grasped, as for example, by a user boarding the water craft from the side or rear.

Figure 4:
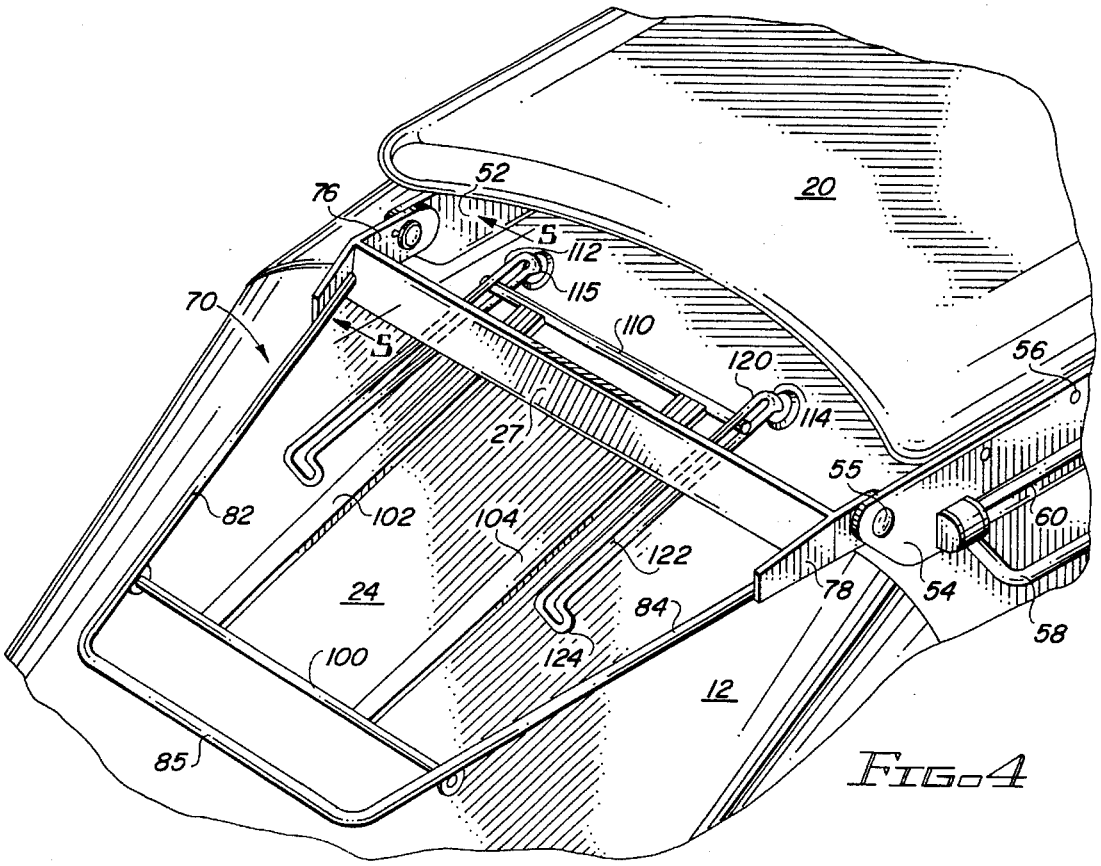
FIG. 4 is a perspective view of the aft portion of the water craft showing the seat support structure in a stored position with the seat cushion removed for clarity.
Figure 6:
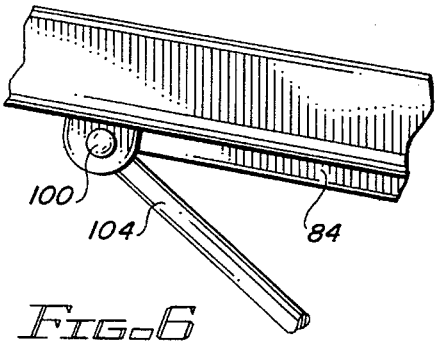
FIG. 6 is a detail view of the pivot connection on the seat.

A seat frame 70 is pivotally attached between the side bracket 52 and 54. The seat bracket consists of a cross member 27 having flanges 76 and 78 at opposite ends. Cross bar 27 is disposed at an angle with respect to flanges 76 and 77 so that the plane defined by the surface of cross-bar 27 is generally co-extensive with or inclined upwardly with respect to seat 20 in the deployed position shown in FIG. 1. The seat 50 generally assumes a position against the rear portion of the hull when the seat is in the folded or stored position shown in FIG. 4. The seat support frame is completed by opposite side bars 82 and 84 which extend rearwardly from cross-bar 27. Side bars 82 and 84 may be parallel or may be slightly convergent as seen in FIG. 4. The distal ends of the side bars 82 and 84 are joined by transverse member 85. The seat frame 70, consisting of cross member 27, side members 82 and 84, and member 85 may themselves establish a seating surface. Preferably, however, a cushion 90 is supported on the seat frame. The cushion 90 has an exterior covering of suitable weather-resistant material such as vinyl or polyurethane with interior padding such as expanded polyfoam. Cushion 90 is secured to and supported by the seat frame 70.

Figure 2:
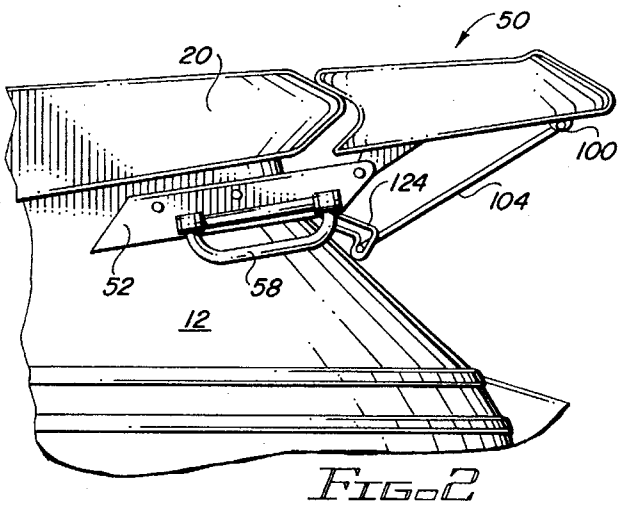
FIG. 2 is a detailed view of the seat as shown in FIG. 1.

The seat frame is pivotal between the stored or out-of-the-way position as shown in FIG. 4 to a deployed use-position as seen in FIG. 2. To facilitate the folding of the seat frame, a pair of braces 102 and 104 are pivotally secured to the side bar members 82 and 84 by a transverse shaft 100. The distal ends of the braces 102 and 104 are attached to a rod 110 which extends generally transversely with respect to braces 102 and 104. The opposite ends of rod 110 are received in rail members 112 and 114 which are each secured to the rearwardly sloping portion of the hull by fasteners 115. The rail members 112 and 114 are essentially identical to one another each having a generally elongated body 120 defining an axially extending slot 122 which forms a track. The lower end of the tracks define a recess 124 which forms a detent.

Figure 3:
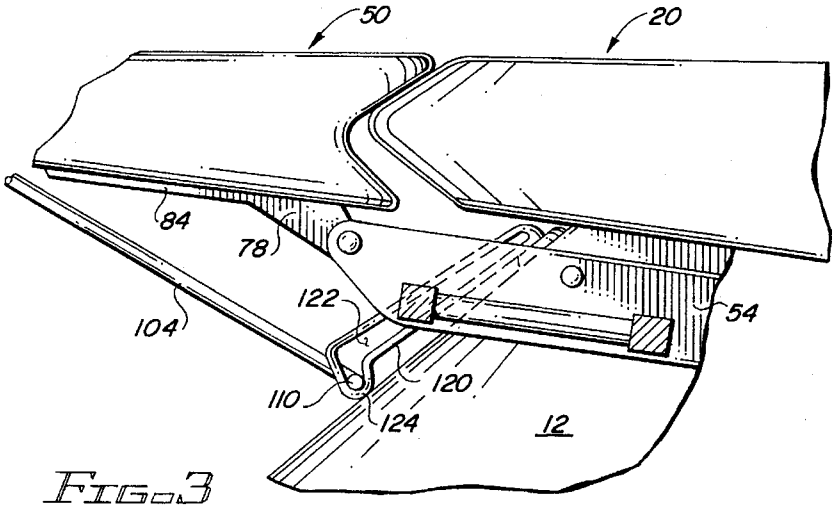
FIG. 3 is an enlarged detailed view showing the seat support mechanism.

It will be seen that the ends of rod 110 are slidable along the track 122. When the seat is in a collapsed or folded position, the rod 110 is positioned near the upper end of the track 120. When the user moves the seat to an elevated use-position, the seat will pivot about pivot points 55. The upward pivotal motion of the seat frame will cause the bar 110 to move downwardly in track 122 until the ends of slide bar 110 are seated in the detent of 124 of each of the tracks. In this position, the seat is in the use position as shown in FIGS. 1 and 3. The weight of the user on the seat will tend to hold the seat in the proper position.

Figure 5:
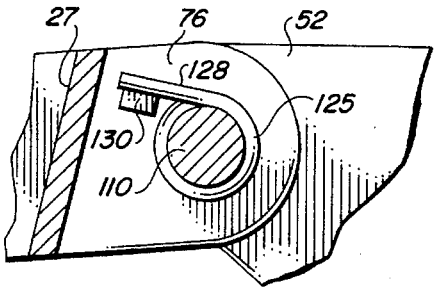
FIG. 5 is a sectional view taken along line 5—5 of FIG. 4.

Preferably, the seat is normally spring biased to the folded position of FIG. 4. Referring to FIG. 5 which is a cross-sectional view as indicated in FIG. 1, a torsional spring 125 extends about shaft 110. The torsional spring has a projection 128 which engages a stop 130 on the interior surface of flange 76. The torsional spring 125 exerts a biasing force on the spring frame urging it to the stored or folded position.

When the seat frame is manually raised to the deployed position against the force of the spring and the braces are engaged in a detent slide, the spring force will also assist in maintaining the seat in the deployed or riding position. When the ends of the rod 110 are manually removed from the detent 124, the torsional spring will urge the seat toward the folded position causing the rod 100 to move upwardly in the track slots. The folding seat facilitates boarding the water craft from the rear. Grips 58 assist the passenger both when boarding and when riding.

The components of the auxiliary seat, such as the slide track brace and brackets, can be made from any suitable material that has adequate strength and is resistant to the environment. These components can be made of a stainless steel or suitable high strength plastic. The seat cushion as described above is covered similar to a factory installed seat.

Figure 7:
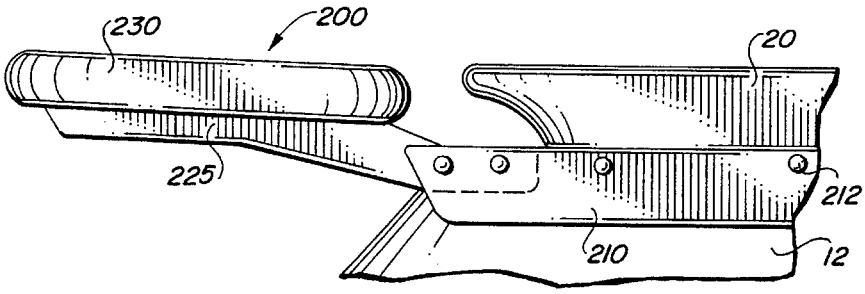
FIG. 7 is a side view of an alternate embodiment of the present invention.

In FIG. 7, an alternate embodiment of the invention is shown designated by the numeral 200 which is attached to the stern of the hull 12 aft of seat 20. Brackets 210 are secured to the hull by fasteners 212 and support a cantilever seat frame 225 which is slightly angularly disposed with respect to seat 20. Seat frame 225 is covered with a cushion 230.

From the foregoing, it will be seen that the present invention provides an auxiliary seat for personal water craft which provides additional space for the passenger. Normally, the seat would provide approximately an additional 8 to 12 inches of seat space for the passenger. This allows both the driver and passenger to sit in a more comfortable and natural position. Another advantage of the present invention is that some of the more substantial two-seat personal water craft units have sufficient power to be classified as a three-seat water craft. The addition of the auxiliary seat may permit such two-seat units to be classified as three-seat units by the U.S. Coast Guard.

It will be obvious to those skilled in the art to make various changes, alterations and modifications to the invention described herein. To the event these various alterations, modifications and changes do not depart from the spirit and scope of the appended claims, they are intended to encompass therein.

I claim:

1. An auxiliary seat for personal water craft of the type having a hull with a bench type seat, said hull having a stern hull surface disposed rearwardly below said bench type seat, said auxiliary seat comprising:

(a) a seat frame pivotally secured to said hull at a location adjacent the rear of said bench seat;

(b) a brace pivotally secured to said seat frame engageable to position said seat frame in a first deployed position extending generally rearward from said bench seat and a second stored position against said stern hull surface.

2. The auxiliary seat of claim 1 further including track means on said stern hull surface and engageable with said brace to secure said brace in said first deployed position.

3. The auxiliary seat of claim 2 wherein said brace comprises a pair of braces and wherein said braces are secured to a slide rod engageable in said track means and wherein said track means define a detent position for securing said braces with said frame in said deployed position.

4. The auxiliary seat of claim 3 wherein said track means comprise an elongate slot in a rail and said detent means comprises a recess positioned along said slot.

5. The auxiliary seat of claim 1 further including a cushion means supported on said seat frame.

6. The auxiliary seat of claim 1 further including biasing means normally biasing said seat frame to said second stored position.

7. The auxiliary seat of claim 1 further including brackets attached to said hull wherein said seat frame is pivotally secured to said brackets, said brackets being disposed along opposite sides of the hull.

8. The auxiliary seat of claim 1 further including grip handles secured to said hull.

9. An auxiliary seat for a personal water craft of the type having a bench type seat, said hull having a stern hull surface disposed rearwardly below said bench type seat, said auxiliary seat comprising:

(a) mounting means secured to said hull extending rearwardly from said hull; and (b) a seat frame supported by said mounting means.

10. The auxiliary seat of claim 9 wherein said mounting means are cantilevered from said hull.

11. The auxiliary seat of claim 10 further including a seat cushion carried on said seat frame.

* * * * *